US005174480A

United States Patent [19]

Otokuni

[11] Patent Number: 5,174,480

[45] Date of Patent: Dec. 29, 1992

[54] WORKPIECE FOLDING APPARATUS

[75] Inventor: Tadashi Otokuni, Tokyo, Japan

[73] Assignee: Juki Corporation, Tokyo, Japan

[21] Appl. No.: 721,238

[22] Filed: Jun. 26, 1991

[30] Foreign Application Priority Data

Jun. 27, 1990 [JP] Japan ..... 2-169279

[51] Int. Cl.[5] ..... A41H 33/00

[52] U.S. Cl. ..... 223/38; 112/121.12; 112/121.15; 112/147

[58] Field of Search ..... 112/121.12, 121.15, 112/121.11, 68, 147, 104, 141, 262.3, 265.1; 223/38; 270/32, 37

[56] References Cited

U.S. PATENT DOCUMENTS

| | | | |
|---|---|---|---|
| 4,481,895 | 11/1984 | Asao et al. | 112/68 X |
| 4,493,276 | 1/1985 | Sadeh | 112/121.15 X |
| 4,665,843 | 5/1987 | Goldbeck et al. | 112/68 |
| 4,982,676 | 1/1991 | Morii et al. | 112/121.15 |
| 5,058,517 | 10/1991 | Morii et al. | 112/121.15 |

*Primary Examiner*—Peter Nerbun
*Attorney, Agent, or Firm*—Morgan & Finnegan

[57] ABSTRACT

A folding sequence for cylinders, which are so powered as to fold pocket pieces in a good order, is inputted into a control box and stored in a storage medium. Many different pocket pieces may then be folded according to the inputted folding sequence for the cylinders by reading the inputted data from the storage medium.

2 Claims, 8 Drawing Sheets

WORKPIECE FOLDING APPARATUS

FIELD OF THE INVENTION

The present invention relates to a workpiece folding apparatus which is capable of establishing a folding sequence of pocket pieces in various forms and folding each of the pocket pieces so as to create a better appearance.

BACKGROUND OF THE INVENTION

An automatic sewing machine, as shown in FIG. 6, has been heretofore proposed for sewing the pocket pieces onto a garment body. This earlier apparatus includes a housing 1 upon which a sewing machine 2 is mounted. This sewing machine is formed on one side thereof with an X-Y drive unit 3. The drive unit 3 includes a workpiece presser 4 which is mounted for movement in the X-Y axes. A workpiece folder 5 is mounted on one end of the housing 1.

The workpiece folding apparatus 5 is shown in FIG. 7 and includes a pattern 7 coupled to a horizontal cylinder 6, and a work plate 8 having a cylinder group 9 thereon which is disposed to encircle the pattern 7. The cylinders 9 carry auxiliary plates 10 thereon. The work plate 8 and a presser plate 16 are vertically moved by a vertical cylinder 11. A frame 12 is mounted on the workpiece presser 4 and is provided with a groove 12*a* so formed as to follow and compensate the pattern 7. A stacker 13 is disposed in front of the sewing machine 2.

As seen from FIG. 8(a), the automatic sewing machine arranged in the aforementioned manner functions so that the work plate 8 is retracted upwardly from the pattern 7 by the vertical cylinder 11 to place a garment body 14 on the housing 1, as shown in FIG. 8(*a*). The horizontal cylinder 6 is driven to move the pattern 7 to the upper portion of the garment body 14, and the pocket piece 15 is laid on the pattern 7 so that a presser plate 16 and the work plate 8 are lowered to clamp the pocket piece 15 between the pattern 7 and the presser plate 16, as shown in FIG. 8(*b*). Now, the vertical cylinder 11 is driven to lower the work plate 8 and the presser plate 16 at the same time. The cylinder group 9 is then actuated, as illustrated in FIG. 8(*c*), to allow the auxiliary plates 10 to fold and engage the edge of the pocket piece 15 with the pattern 7 on the other side thereof. The folded pocket piece 15 is lowered by the vertical cylinder 11 to the body 14, as seen from FIG. 8(*d*). The cylinder groups 9 are then returned to their original position, as shown in FIG. 8(*e*), to then raise the presser plate 16 and the work plate 8 by means of the vertical cylinder 11, as shown in FIG. 8(*f*).

Next, frame 12 when moved to carry the body 14 and the pocket piece 15 thereon, is then moved towards the foot of the needle of the sewing machine 2 upon removal of the pattern 7, to sew the pocket piece 15 to the body 14. The body 14 to which the pocket piece 15 is sewn is stacked within the stacker 13.

The workpiece folding apparatus for an automatic sewing machine fabricated as above mentioned is adapted to drive the cylinders in a predetermined sequence. However, changing the sequence is difficult. Although those who are skilled in the art are well aware that the product may be improved in quality where the workpiece folding sequence is varied, this results in many complicated and troublesome techniques which require mechanically adjusting the sequence, as well as the increased effort of changing the software used.

It is therefore an object of the present invention to provide a workpiece folding apparatus which is capable of inputting a folding sequence for pocket pieces through a control panel or box, establishing the sequence thereof conforming to the shape of the pocket piece, and storing the sequence of operations in a storage medium.

Another object of the invention is to provide a workpiece folding apparatus which is capable of inputting both the drive sequence and timing of the cylinders through the control box, and allows the user to adjust these settings to their satisfaction.

SUMMARY OF THE INVENTION

To accomplish these and other objects of the invention, a workpiece folding apparatus is provided which includes a pattern on which a pocket piece is laid, and cylinder groups which are so mounted on the periphery of the pattern as to drive auxiliary plates. The folding apparatus also includes a work plate adapted for vertical movement with the cylinders and the auxiliary plate. The folding apparatus further includes a control box which comprises an operative button for inputting a sequence of cylinder operations, a display device for displaying the sequence of operations, and a storage medium for storing therein the inputted sequence of operations, whereby the cylinder group is actuated according to the sequence of operations as stored in the storage medium.

BRIEF DESCRIPTION OF THE DRAWINGS

The invention will be described in greater detail below with reference to the attached drawings, in which.

DETAILED DESCRIPTION OF THE DRAWINGS

Figure 1:
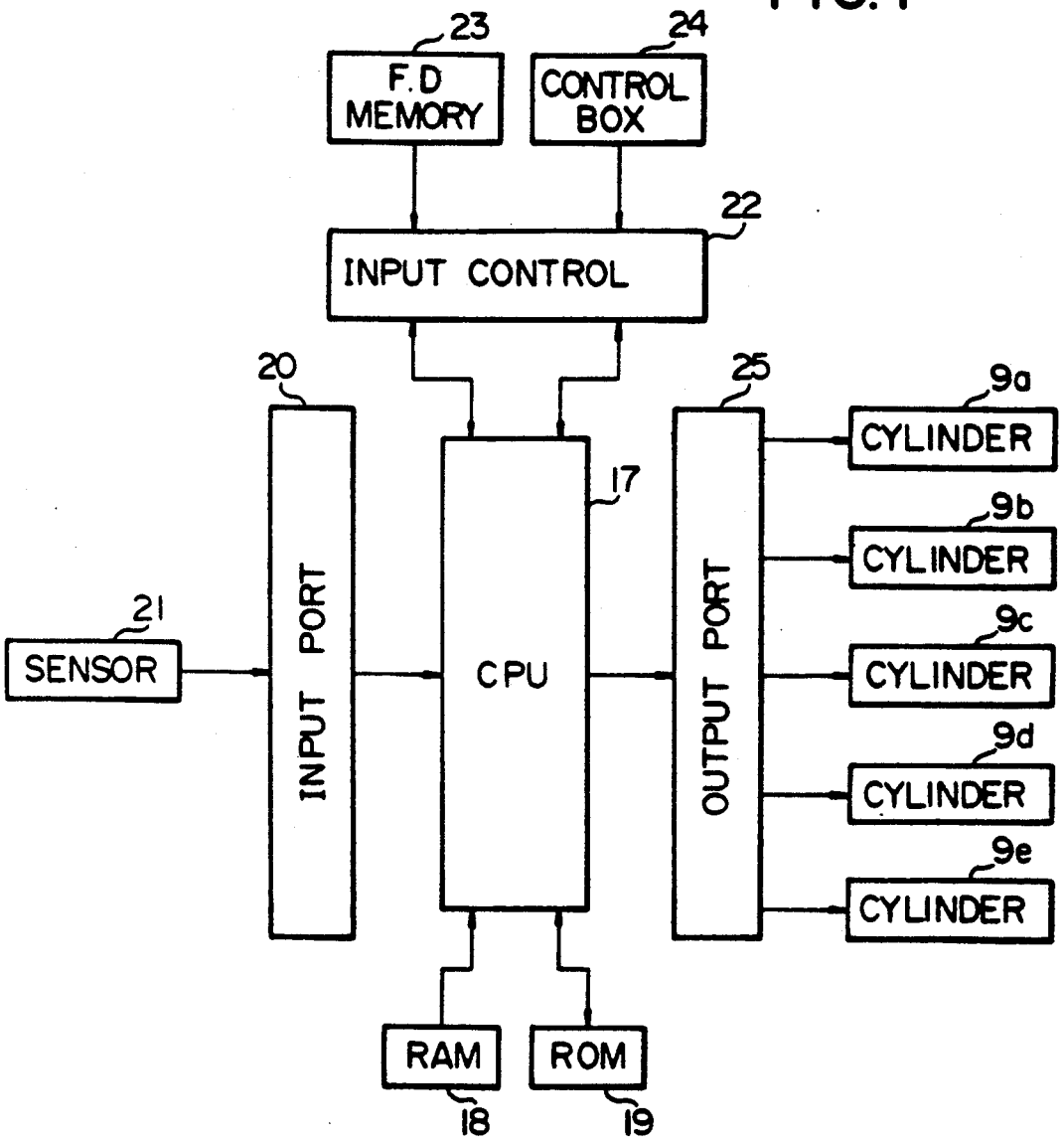
FIG. 1 is a block diagram of a control device for controlling a workpiece folding apparatus according to one embodiment of the invention.

Referring to FIG. 1, a workpiece folding apparatus according to one embodiment of the invention includes the following elements: a CPU (central processing unit) 17, a RAM (random access memory) 18, a ROM (read only memory) 19, an input port 20 to which a sensor 21 is connected, and an output port to which the cylinder group 9 is connected, namely, 9a, 9b, 9c, 9d and 9e. The CPU 17 is provided with an input control 22 to which a FD (floppy disc) memory 23 and a control box 24 are connected. The control box 24, as shown in greater detail in FIG. 2A, has a second display 24b which indicates the "ON TIME" and "OFF TIME" (which will be defined later in reference to FIG. 5) of a cylinder group 9, as shown in FIG. 3. A first display 24a is adapted for selecting each of the cylinders 9a, 9b, 9c, 9d, and 9e in connection with the "ON TIME" and the "OFF TIME" of each cylinder. A set finish button 24d is provided which is pressed when the settings are completed. A test mode selective key 24e and a return key 24c for returning to the previous screen are also provided.

Figure 2A:
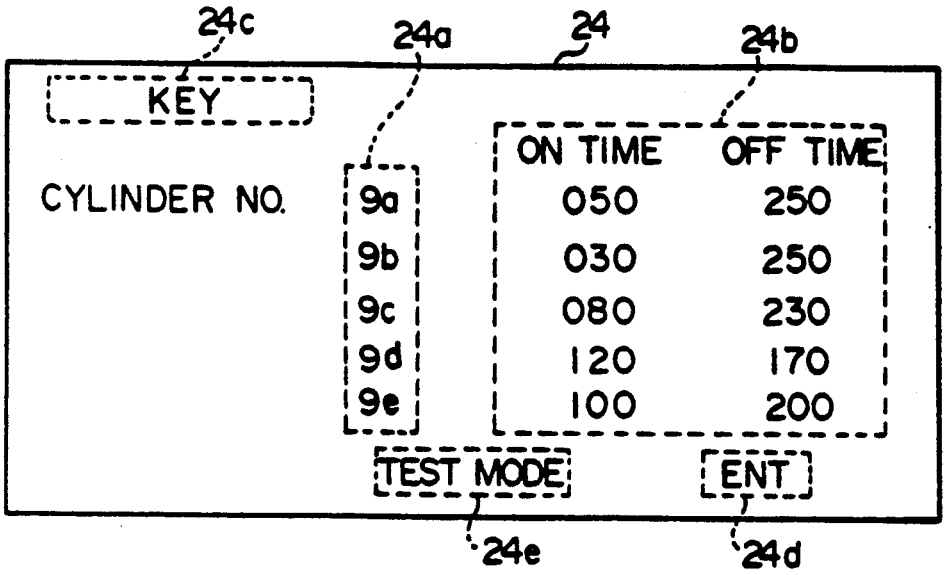
FIG. 2A is a front view of a control box for the control device shown in FIG. 1.
Figure 2B:
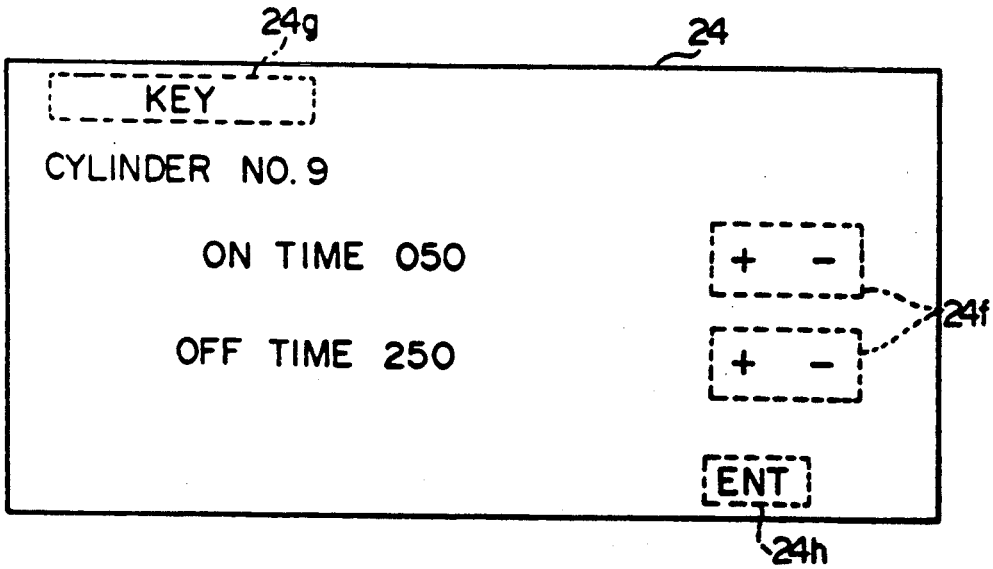
FIG. 2B is a representation showing a display of the control box shown in FIG. 2A.
Figure 3:
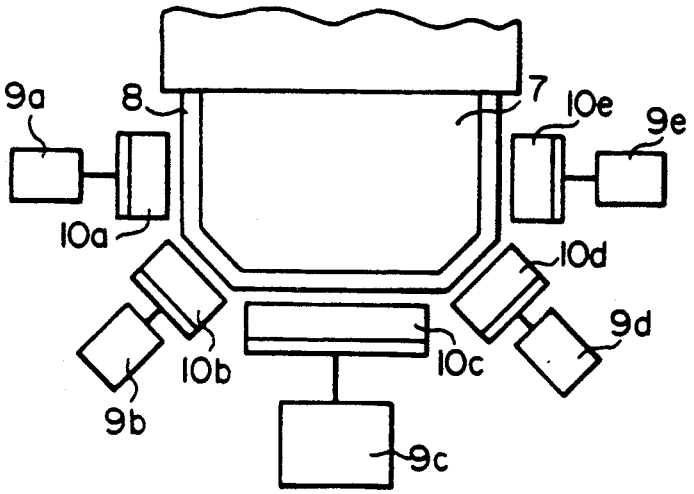
FIG. 3 is a plan view of the workpiece folding apparatus showing the manner of operation of the present invention.

For instance, the screen, as illustrated in FIG. 2A, may be obtained by choosing one of the numerals which designates a cylinders in the first display 24 to be in the "ON TIME" and the "IN TIME" mode. On the screen shown in FIG. 2B, there is displayed a key 24f which is used to increase or decrease the "ON TIME" and the "OFF TIME", a key 24g for returning to the screen shown in FIG. 2A, and a set finishing key 24h. FIG. 2B shows the screen displayed after the selection of one of the cylinders in display 24a, with this cylinder's "ON TIME" and "OFF TIME" information shown. As shown in FIG. 1, the cylinders 9a, 9b, 9d, and 9e are connected to an output port 25.

Figure 4:
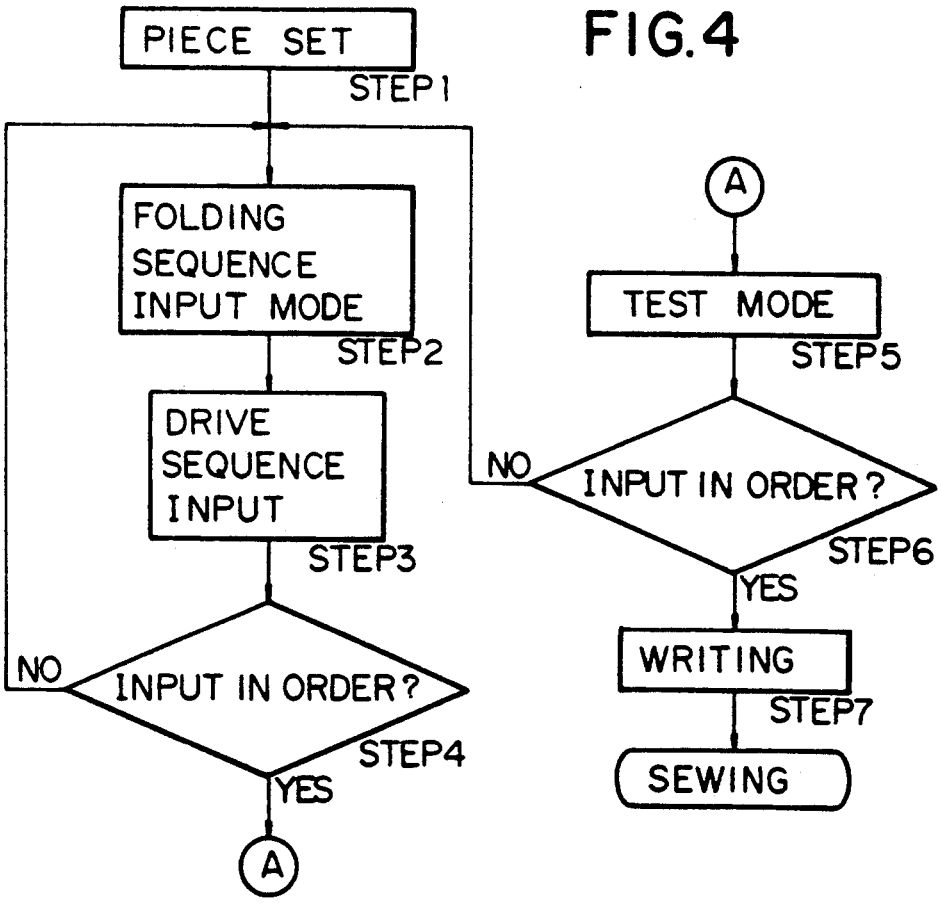
FIG. 4 is a flow chart showing how the control apparatus in FIG. 1 is driven.
Figure 5:
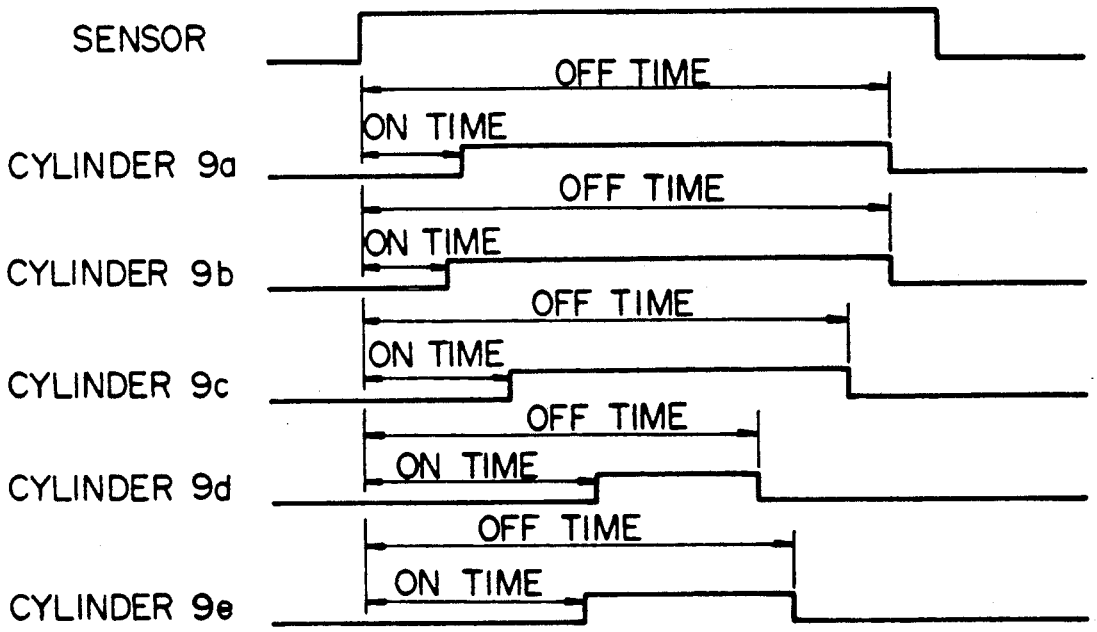
FIG. 5 is a time chart for setting the operation of the cylinder groups for the instant apparatus shown in FIG. 1.
Figure 6:
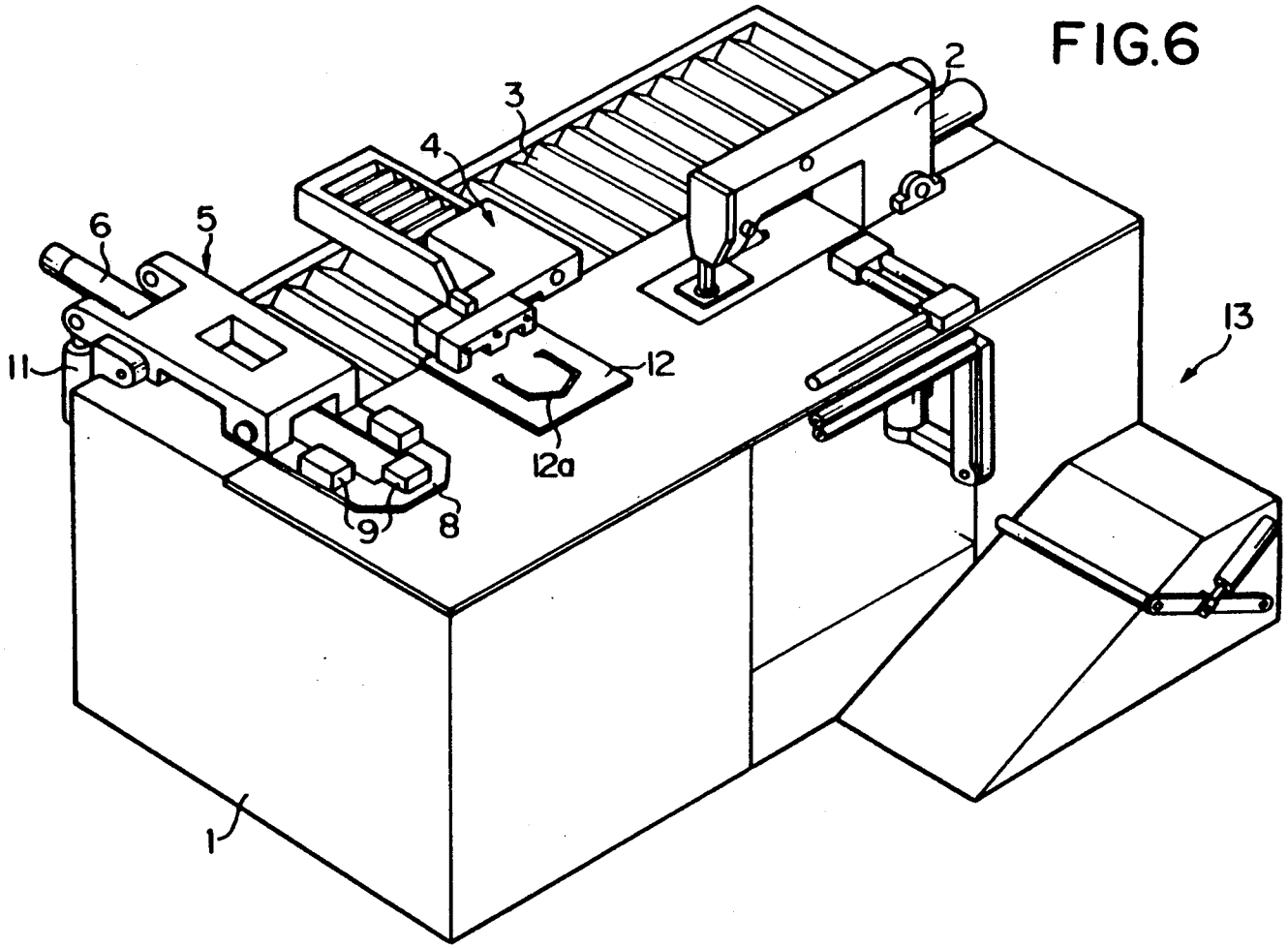
FIG. 6 is a perspective view of a conventional automatic sewing machine for sewing a pocket piece.
Figure 7:
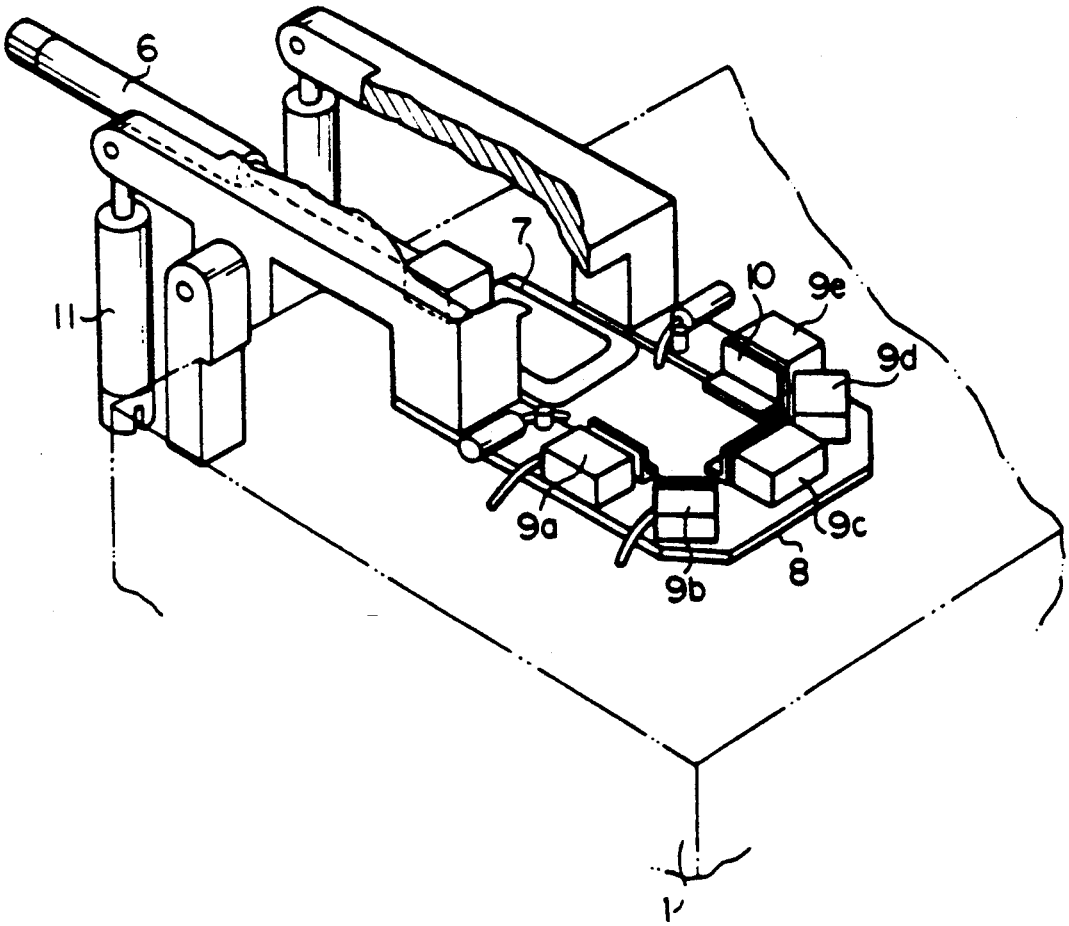
(PRIOR ART) FIG.7
FIG. 7 is a perspective view of a workpiece folding apparatus of the conventional automatic sewing machine illustrated in FIG. 6.
Figure 8A:
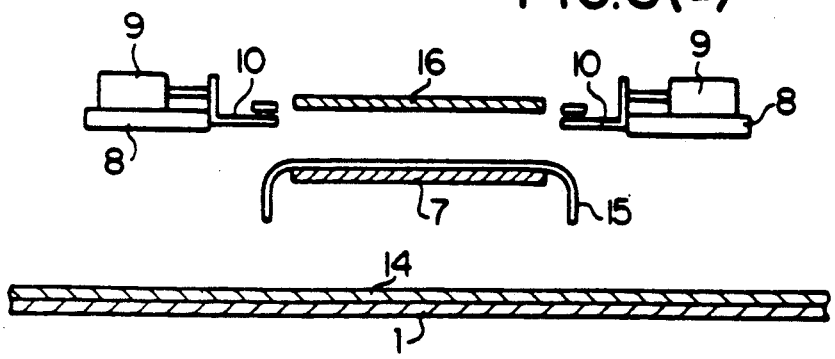
(PRIOR ART) FIG.8(a)
FIG. 8 is a representation showing how the workpiece folding apparatus of a conventional automatic sewing machine is actuated.
Figure 8B:
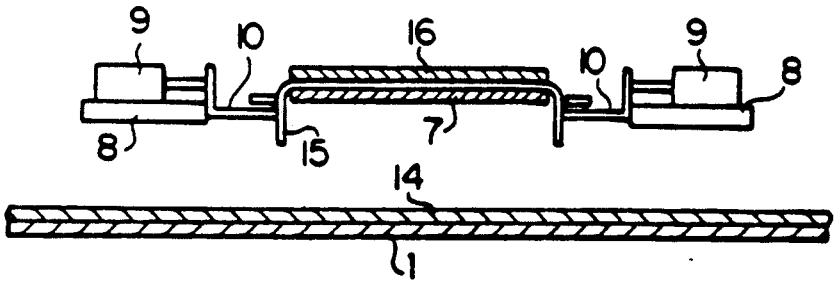
Figure 8C:
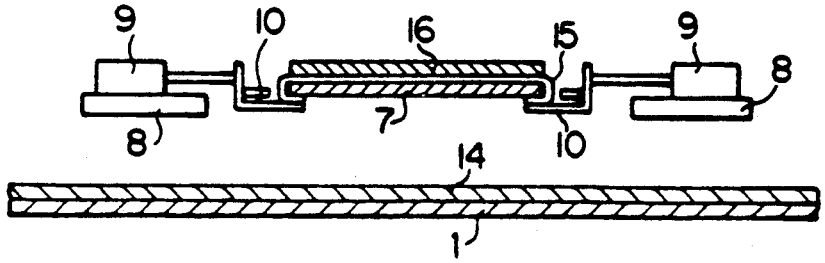
Figure 8D:
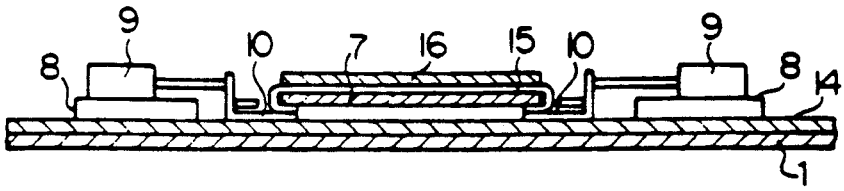
(PRIOR ART) FIG.8(d)
Figure 8E:
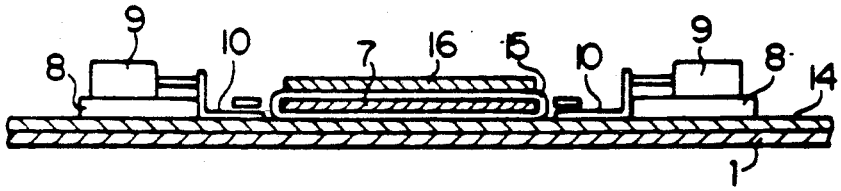
Figure 8F:
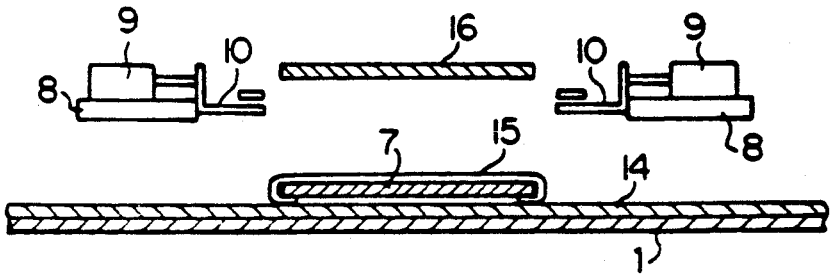

Operation of the workpiece folding apparatus is apparent from the following description, by reference to the flow chart of FIG. 4 and the time chart of FIG. 5. Referring to FIG. 4, the pocket piece 15 is positioned on the pattern 7 as shown by Step 1, and the folding sequence is then inputted through the control box 24. If no data is then available for the folding sequence, Step 2 is automatically carried out in a folding sequence input mode. The cylinder number may then be selected by the first display 24a to obtain the screen as shown in FIG. 2B, wherein the intervals such as "ON TIME" and "OFF TIME" may be adjusted by the key 24f, thereby inputting the drive sequence of the cylinder group, as shown by Step 3. The set finish button 24d is depressed when the setting is completed to obtain the screen of FIG. 2A, wherein the inputted sequence may be inspected through the second display 24b, as shown by Step 4. If an input is incorrect, the folding sequence input mode, shown in Step 2, is repeated. If the input is in good order, the sequence is then inspected through the second display 24b by manipulating the test mode key 24e to invoke the test mode shown by Step 5. The test mode for inspection is then activated, Step 6, to confirm whether the input is made in good order. If not, the step is directed back to Step 2 for reinspection. However, where the input is in good order, the set finish button is then pressed to complete the setting. Simultaneously with this setting, the sequence of cylinder selections is stored in the floppy disc memory 24 or the RAM 18 (Step 7) to then effect automatic sewing.

Referring to FIG. 5, there is shown a time chart, wherein the cylinder group 9 is activated according to a signal from the sensor 21 mounted on the vertical cylinder 11 (FIG. 1). More specifically, when the sensor 21 generates a signal, each of the cylinders 9a, 9b, 9c, 9d, and 9e is energized and then deenergized. In this connection, the term "ON TIME" is used herein to mean the interval in which the sensor 21 generates the signal until the time when the cylinder is energized, whereas the term "OFF TIME" is used herein to mean the interval in which the sensor generates the signal until the time when the cylinder is de-energized. In this instance, it is noted that if the "OFF TIME" is less than the "ON TIME", this is processed as an "error", and that if the "ON TIME" is as long as the "OFF TIME", the cylinder is inactive. All the cylinders are entirely subject to the inputted sequence of data stored in the floppy disc memory 23 or the RAM 18 when the register key 24d is depressed. Thereafter, the sequence data corresponding to the inputted patterns are used to actuate the cylinder group. Where there is no sequence data furnished which corresponds to fresh patterns, the control box is set for the folding sequence mode, due to the fact that the data to be inputted are read out from the floppy disc memory 23 or the RAM 18. The setting may be made in such a manner that the cylinder group is made operative during the time when the vertical cylinder 11 is lowered, and that the cylinder group is set to complete its performance during the time when the vertical cylinder is lowered.

According to the invention, the drive sequence for the cylinders is inputted by the control box into the storage medium. The inputted sequence data directs the cylinders to hold the pocket piece which is laid on the pattern and determine if the drive sequence for the cylinder is in good order. If so, writing is done on the storage medium to thus effect sewing. This drive sequence for the cylinder may be used by reading it out from the storage medium when the pocket pieces are of the same shape.

Although the invention has been described in detail herein by way of reference to the disclosed embodiment, it should be understood that the invention is not limited to the disclosed embodiment, but should be interpreted in accordance with the claims which follow.

I claim:

1. A workpiece folding apparatus comprising:

a table;

a pattern arranged on said table for mounting thereon a workpiece;

a plurality of auxiliary plates for folding said workpiece;

a plurality of cylinders connected to said auxiliary plates, each cylinder driving a corresponding auxiliary plate;

a work plate for supporting said auxiliary plates and said cylinders;

driving means for moving said work plate toward said pattern;

a sensor for detecting the dropping of said work plate onto said pattern and generating a signal;

input means for inputting an on-time and an off-time of each said cylinder;

memory means for storing said on-time and off-time data from said input means;

control means for actuating said cylinders by said signal from said sensor in accordance with said data read out from said memory means, wherein each cylinder is energized during the time based on said input means.

2. A workpiece folding apparatus comprising:

a table;

a pattern arranged on said table for mounting thereon a workpiece;

a plurality of auxiliary plates for folding said workpiece;

a plurality of cylinders connected to said auxiliary plates, each cylinder driving a corresponding auxiliary plate;

a work plate for supporting said auxiliary plates and said cylinders;

driving means for moving said work plate toward said pattern;

a sensor for detecting the dropping of said work plate onto said pattern and generating a signal;

input means for inputting an on-time and an off-time of each said cylinder, whereby said on-time and off-time data indicate the time during which said each cylinder is energized;

memory means for storing said on-time and off-time data from said input means; and control means for actuating said cylinders by said signal from said sensor in accordance with data read out from said memory means, wherein each cylinder is energized during the time based on said input means.

* * * * *